United States Patent [19]

Iverson

[11] Patent Number: 4,874,331

[45] Date of Patent: Oct. 17, 1989

[54] STRAIN RELIEF AND CONNECTOR - CABLE ASSEMBLY BEARING THE SAME

[75] Inventor: Ralph Iverson, Granada Hills, Calif.

[73] Assignee: Whittaker Corporation, Los Angeles, Calif.

[21] Appl. No.: 220,864

[22] Filed: May 9, 1988

[51] Int. Cl.[4] ..... H01R 13/59

[52] U.S. Cl. ..... 439/449; 439/583

[58] Field of Search ..... 439/445–449, 439/452, 470, 583, 98, 610

[56] References Cited

U.S. PATENT DOCUMENTS

| | | | |
|---|---|---|---|
| 2,460,304 | 2/1949 | McGee et al. | 439/583 |
| 2,678,963 | 5/1954 | Everhart | 439/98 |
| 3,040,288 | 6/1962 | Edlen et al. | 439/452 |
| 3,986,765 | 10/1976 | Shaffer et al. | 439/449 |
| 4,307,926 | 12/1981 | Smith | 439/610 |
| 4,433,206 | 2/1984 | Lewis | 439/610 |

FOREIGN PATENT DOCUMENTS

| | | | |
|---|---|---|---|
| 2410106 | 9/1975 | Fed. Rep. of Germany | 439/583 |
| 1499149 | 10/1967 | France | 439/583 |
| 2091498 | 7/1982 | United Kingdom | 439/447 |

*Primary Examiner*—Gary F. Paumen

*Attorney, Agent, or Firm*—Donald E. Nist

[57] ABSTRACT

The strain relief device is used in combination with a metal electronic cable-connector assembly for high temperature applications and high mechanical shock application. The strain relief shrouds and protects the weld or braze between the cable and connector and also extends over a length of the cable to brace it from bending stress ad strain. The strain relief is generally hollow and tubular, an expanded end thereof being slip fitted over and/or welded to or threaded into an end of the connector and caused to extend over the cable-connector weld or braze, with a narrow end of the strain relief forming a lip surrounding the cable distal of the weld or braze to brace it. Thus, the cable and described connector end fit into the central longitudinal passageway in the strain relief and are enclosed by it. The strain relief can be in a form such that its central portion extends through a bulkhead and can be locked thereto. The strain relief lip can also be lined with one or more elastomeric pads or rings to increase resistance to mechanical shock. The strain relief is fabricated of metal or plastic or the like, depending on the application desired. Normally, the cable and connector, preferably a male-female connector, are of metal.

3 Claims, 2 Drawing Sheets

STRAIN RELIEF AND CONNECTOR - CABLE ASSEMBLY BEARING THE SAME

BACKGROUND OF THE INVENTION

1. Field of the Invention

The present invention generally relates to electronic cable-connector assemblies and more particularly to such an assembly bearing a novel strain relief.

2. Prior Art

Major field failures of metal-jacketed, mineral-filled electronic cables are the result of fractures which develop in the cable's outer jacket immediately behind the weld or braze attachment to the connector. Most of these failures are caused by high thermal stresses induced by improper or inadequate strain relief. Certain failures are also induced by high mechanical shock and vibration.

Accordingly, there is a need for an improved device capable of ameliorating or preventing the described fractures from occuring. Preferably, such device should be simple, adapted to a variety of sizes, designs and applications and capable of being used in metal or plastic form.

SUMMARY OF THE INVENTION

The improved strain relief device of the present invention satisfies all the foregoing needs. This strain relief is substantially as set forth in the Abstract of the Disclosure. Thus, the strain relief is a hollow, generally tubular device with a central passageway extending longitudinally therethrough. One end of the device is expanded to slip fit over and preferably be welded to or be threaded onto the outer surface of one end of the connector of a connector-cable assembly, shrouding and enclosing the point where the braze or weld between the connectors and cable occurs. The strain relief thus has the connector end and associated portion of the cable in its central passageway, with the cable extending out the narrow reduced opposite end of the strain relief at a point distal to the point of the weld or braze. That reduced end forms a peripheral lip which braces the cable against thermal and mechanical stress. Preferably, the lip is lined with an elastomeric pad or ring to further reduce high mechanical stress.

The strain relief can also be made to fit through a bulkhead, with its central portion lockable thereto. The strain relief, if made of plastic rather than metal, must be threaded to the connector end. Normally in the usual female-male connector-cable assembly configuration a separate strain relief will be used at each end of the connector to cover both cable ends and braze or weld points.

Various other features of the improved strain relief and assembly incorporating the same are set forth in the following detailed description and accompanying drawings

DRAWINGS

Figure 5:
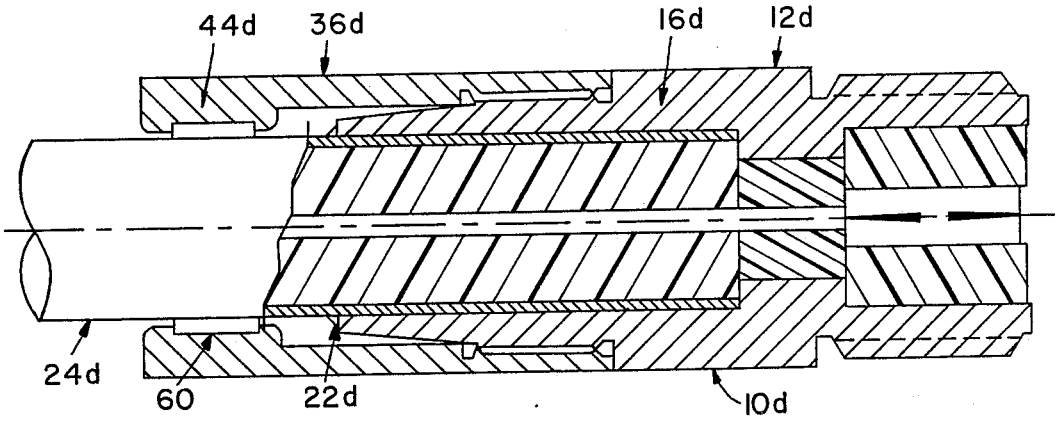
Figure 6:
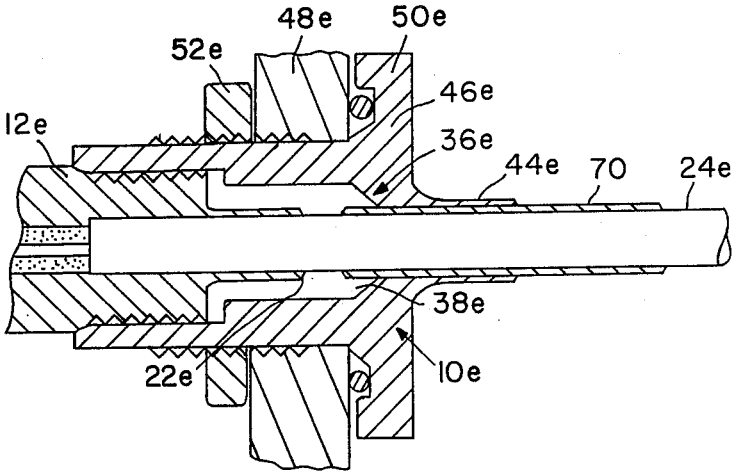

FIG. 5 is a schematic side elevation, partly broken away, of a fifth preferred embodiment of the improved strain relief of the present invention, shown in place on one end of a male-female connector-electronic cable assembly; and, FIG. 6 is a schematic side elevation, partly broken away, of a sixth preferred embodiment of the improved strain relief of the present invention releasably lockable to a bulkhead and disposed over an end of a connector-electronic cable assembly.

DETAILED DESCRIPTION

FIG. 1

Figure 1:
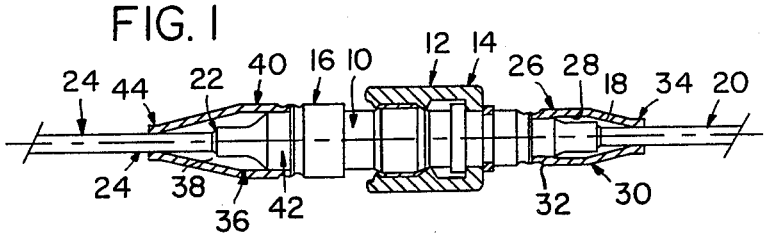
FIG. 1 is a schematic side elevation, partly in section, of a first preferred embodiment of a pair of the improved strain reliefs of the present invention in place on opposite ends of a male-female connector-electronic cable assembly.

Now referring more particularly to FIG. 1 of the drawings, a first preferred embodiment of the improved strain relief and assembly of the present invention is schematically depicted therein. Thus, assembly 10 is shown which comprises a connector 12 having a male component 14 and a female component 16 releasably connected to each other. Component 14 is metal and is brazed or welded at end point 18 to metallic sheathed electronic cable 20, while component 16 is metal and is brazed or welded at end point 22 to a second metallic electronic cable 24.

Point 18 is shielded from thermal and mechanical stress by a metallic strain relief 26, which comprises a generally tubular hollow device having a central longitudinal passageway 28 extending therethrough. Relief 26 has an expanded end 30 which slip fits over and is preferably welded to the outer surface of portion 32 of component 14. Strain relief 26 encloses point 18 in passageway 28 and extends out over cable 20, ending in a reduced diameter extended lip 34 which peripherally supports cable 20 at a point distal to point 18 from bending or other mechanical stress and thermal stress. Thus, cable 20 is protected by stress relief 26, as is point 18.

Similarly, point 22 is protected by being enclosed in a second metallic strain relief 36 similar to strain relief 26, and including a central longitudinal passageway 38 therethrough and a generally tubular configuration. Thus, expanded end 40 of relief 36 slip fits over and is preferably welded to the outer surface of portion 42 of component 16. Strain relief 36 encloses point 22 in passageway 38 and extends out over cable 24, ending in a reduced diameter extended lip 44 which perferably supports cable 24 in the manner in which lip 34 supports cable 20. Accordingly, assembly 10 includes connector 12, cables 20 and 24 and strain reliefs 26 and 36, fully protecting the same.

FIG. 2

Figure 2:
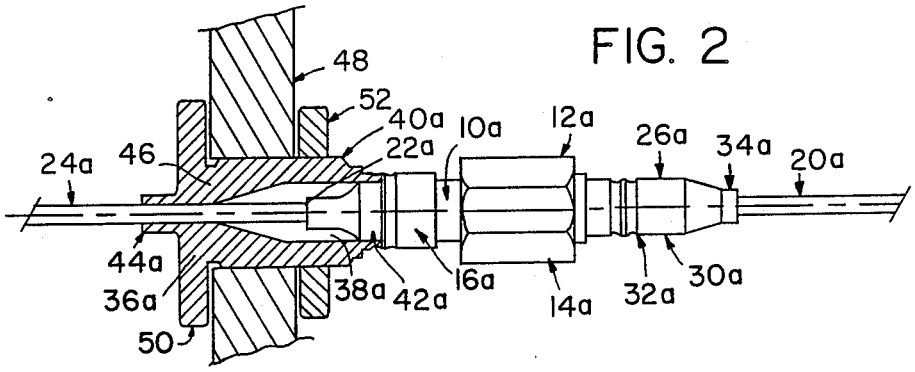
FIG. 2 is a schematic side elevation, partly in section, of a second preferred embodiment of a pair of the improved strain reliefs of the present invention in place on opposite ends of a male-female connector-electronic cable assembly and releasably locked to a bulkhead.

A second preferred embodiment of the improved stress relief and assembly of the present invention is schematically depicted in FIG. 2. Thus, assembly **10*a* is shown. Components thereof similar to those of assembly 10 bear the same numerals but are succeeded by the letter "a". Assembly 10***a* is similar to assembly 10 except as follows:

The central portion 46 of relief 36*a* is expanded and adapted to fit through a bulkhead 48, and bear a peripheral flange 50 abutting one side of bulkhead 48 and lockable in place by a threaded nut 52. Assembly 10*a* has the other features of assembly 10.

FIG. 3

Figure 3:
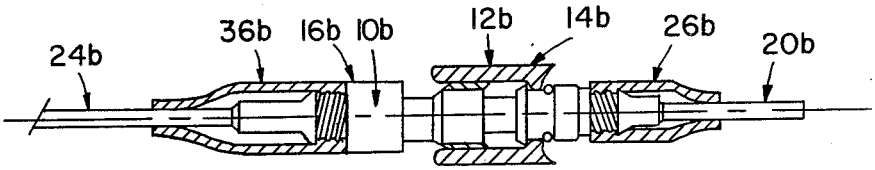
FIG. 3 is a schematic side elevation, partly in section, of a third preferred embodiment of a pair of the improved strain reliefs of the present invention in place on opposite ends of a male-female connector-electronic cable assembly.

A third preferred embodiment of the improved strain relief and assembly of the present invention is schematically depicted in FIG. 3. Thus, assembly 10*b* is shown. Components thereof similar to those of assembly 10 bear the same numerals but are succeeded by the letter "b." Assembly 10*b* is identical to assembly 10, except as follows:

Strain reliefs 26*b* and 36*b* are threaded on to adjoining threaded surfaces of components 14*b* and 16*b*, respectively, instead of being slip fitted and welded in place. Assembly 10*b* has the advantages of assembly 10. Strain reliefs 26*b* and 36*b* can be plastic, if desired.

FIG. 4

Figure 4:
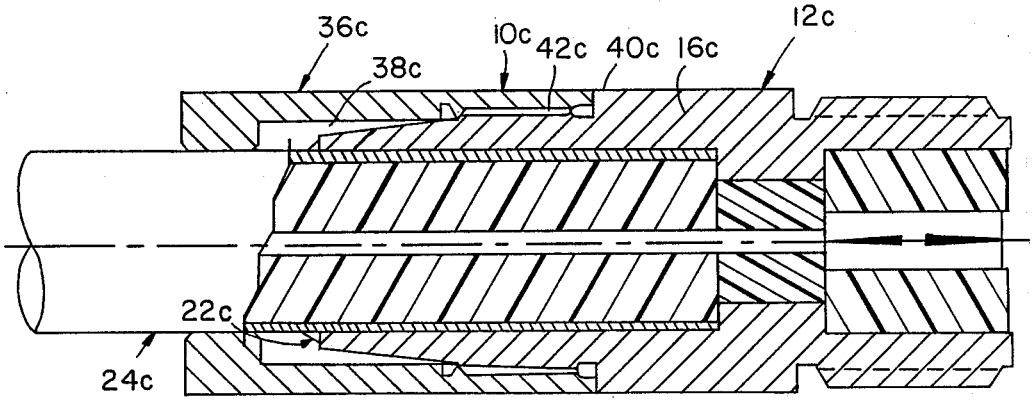
FIG. 4 is a schematic side elevation, partly in section, of a fourth preferred embodiment of the improved strain relief of the present-invention in place on one end of a male-female connector-electronic cable assembly.

A fourth preferred embodiment of the improved assembly and strain relief of the present invention is schematically depicted in FIG. 4. Thus, assembly 10*c* is shown. Components thereof similar to those of assembly 10 bear the same numerals but are succeeded by the letter "c." In FIG. 4, only the female component 16*c* of connector 12*c* is shown, along with cable 24*c* and strain relief 36*c*. Strain relief 36*c* is slip fitted and spot welded to component 16*c* in order to cover point 22*c* and cable 24*c*.

FIG. 5

A fifth preferred embodiment of the improved assembly and strain relief of the present invention is schematically depicted in FIG. 5. Thus, assembly 10*d* is shown. Components thereof similar to those of assembly 10 or 10*c* bear the same numerals but are succeeded by the letter "d." In fact, assembly 10*d* is identical to assembly 10*c* except that lip 44*d* bears on the inner surface thereof one or more flat-sided elastomeric pads or rings 60 which increases the resistance of assembly 10*d* to high mechanical shock. Thus, cable 24*d* and weld (braze) point 22*d* are further protected.

FIG. 6

A sixth preferred embodiment of the improved assembly and strain relief of the present invention is schematically depicted on FIG. 6. Thus, assembly 10*e* is shown. Components thereof similar to those of assembly 10 or 10*a* bear the same numerals but are succeeded by the letter "e". Assembly 10*e* is substantially identical to assembly 10*a* except that it includes a hollow tubular metal sleeve 70 which fits over cable 24*e* and extends into strain relief 36*e* being enclosed by lip 44*e* and welded or brazed to cable 24*e* within space 38*e*. Sleeve 70 further reduces the mechanical stress on cable 24*e* at the juncture of cable 24*e* and lip 44*e*. Moreover, it is more economical to make and install rather than contouring part 50*c* for an exaggerated long lip 44*e*. Assembly 10*e* has the other advantages of assembly 10*a*.

Various other modifications, changes, alterations and additions can be made in the improved strain relief and assembly of the present invention. All such modifications, changes, alterations and additions as are within the scope of the appended claims form part of the present application.

What is claimed is:

1. An improved electronic cable and connector assembly having a strain relief device, said assembly comprising, in combination:

(a) a metal-jacketed, semi-rigid, mineral-filled electronic cable, (b) a metallic connector assembly, one end of which is connected to said cable, and, (c) a hollow, generally tubular metal fitting with a central passageway extending longitudinally therethrough, an expanded end of said fitting being slip fitted over the exterior of said connector assembly adjacent to said one cable-connected end and enclosing the same, and extending over and enclosing the junction of said connector assembly and said cable, said connector assembly and said cable being joined at said junction by one of brazing and welding, said fitting also extending over and enclosing said cable to protect said junction against damage, said fitting having a reduced diameter opposite end with an extended lip of substantially uniform thickness enclosing, abutting and supporting said cable peripherally against strain at a point remote from said junction, said lip being lined with an elastomeric ring of extended surface area for high mechanical shock application.

2. The improved assembly of claim 1 wherein said fitting is adapted to extend through and be locked to a bulkhead, wherein a hollow metallic sleeve is fitted over said cable and extends into said central passageway and is welded or brazed to said cable in said passageway for improved resistance to mechanical stress.

3. The improved assembly of claim 1 wherein said elastomeric ring is flat-sided.

* * * * *